US006498282B1

(12) United States Patent
O'Connor et al.

(10) Patent No.: US 6,498,282 B1
(45) Date of Patent: Dec. 24, 2002

(54) METHOD FOR PROCESSING ALUMINUM SPENT POTLINER IN A GRAPHITE ELECTRODE ARC FURNACE

(75) Inventors: William K. O'Connor, Lebanon, OR (US); Paul C. Turner, Independence, OR (US); Gerald W. Addison, St. Stephen, SC (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 73 days.

(21) Appl. No.: 09/596,438

(22) Filed: Jun. 19, 2000

(51) Int. Cl.[7] ..... A62D 3/00

(52) U.S. Cl. ..... 588/201; 588/212; 588/221; 588/248

(58) Field of Search ..... 588/201, 205, 588/212, 213, 221, 248; 423/DIG. 12; 75/10.46

(56) References Cited

U.S. PATENT DOCUMENTS 5,286,274 A * 2/1994 Lindkvist et al. ..... 75/10.48
5,496,392 A * 3/1996 Sims et al. ..... 75/414
5,558,690 A * 9/1996 Hnat et al. ..... 65/134.8
5,711,018 A * 1/1998 Hittner et al. ..... 588/201

* cited by examiner

*Primary Examiner*—Stanley S. Silverman
*Assistant Examiner*—Eileen E. Nave
(74) *Attorney, Agent, or Firm*—Mark F. LaMarre; Mark P. Dvorscak; Paul A. Gottlieb

(57) ABSTRACT

A method of processing spent aluminum pot liner containing carbon, cyanide compositions, fluorides and inorganic oxides. The spent aluminum pot liner is crushed iron oxide is added to form an agglomerated material. The agglomerated material is melted in an electric arc furnace having the electrodes submerged in the molten material to provide a reducing environment during the furnace operation. In the reducing environment, pot liner is oxidized while the iron oxides are reduced to produce iron and a slag substantially free of cyanide compositions and fluorides. An off-gas including carbon oxides and fluorine is treated in an air pollution control system with an afterburner and a scrubber to produce NaF, water and a gas vented to the atmosphere free of cyanide compositions, fluorine and CO.

20 Claims, 4 Drawing Sheets

| POTENTIAL BATCH MIXTURE | |
|---|---|
| POTLINER | 46–21% |
| MILL SCALE | 37–71% |
| GLASS/SLAG FORMERS | 12–3% |
| BINDERS | 5% |
| TOTAL | 100% |

METHOD FOR PROCESSING ALUMINUM SPENT POTLINER IN A GRAPHITE ELECTRODE ARC FURNACE

CONTRACTUAL ORIGIN OF THE INVENTION

The United States Government has rights in this invention pursuant to a contractual relationship between the inventors and the U.S. Department of Energy (DOE).

BACKGROUND OF THE INVENTION

Aluminum spent potliner (SPL) is generated from the Hall electrolytic cells used in the reduction of Bayer alumina ($Al_2O_3$) to metallic aluminum. The cell, or pot, is lined with carbon, backed by thermal insulation, with a metal collector plate buried in the carbon lining to conduct the current. Thus, the entire carbon lining acts as the cathode. Reaction of the carbon with air at elevated temperatures results in the formation of several cyanide (CN) compounds, primarily sodium cyanide. The primary toxic constituents include the cyanide compounds, at concentrations up to 0.2 weight percent (wt pct), and fluorine, at concentrations up to 15 wt pct. Spent potliner is recovered from the reduction cells after their useful life, and includes the original carbon lining, along with some portion of the insulating refractory used to enclose the cell. The resulting SPL contains carbon, at concentrations from 12–50 wt pct, inorganic oxides (slag formers), at concentrations 30–60 wt pct, and the before mentioned toxic constituents. Due to its toxic constituents, SPL has been listed as a hazardous waste, designated K088, by the U.S. Environmental Protection Agency (EPA). No approved treatment process currently exists for SPL, due to recent legal decisions, and a land ban enacted by the EPA has stopped all landfill. Annual generation of SPL from U.S. plants is estimated at 2–300,000 tons, which is currently stored above ground either on-site or at approved hazardous waste repositories. The SPL thus represents a major future expense and liability to the industry.

The only approved treatment technology for SPL, used by Reynolds Metals Aluminum Co., mixes the SPL with sand, incinerates it, and disposes of the residue in a dedicated landfill in Gum Springs, Ark. However, other aluminum smelting companies are critical of the process, because it results in an increased volume for landfill, the transportation costs for shipping the SPL to the treatment plant in Arkansas exceed the treatment costs themselves, and the treatment standard adopted by the EPA, the Toxicity Characteristic Leaching Procedure (TCLP), does not accurately portray the effectiveness of the Reynolds' process to render the SPL nonhazardous. In fact, the waste treatment standard adopted by the EPA for SPL destined for land disposal is being revised.

SUMMARY OF THE INVENTION

The inventive process constitutes the use of conventional graphite electrode arc furnace (EAF) technology to simultaneously utilize and detoxify the SPL. Hazardous constituents of the SPL, such as cyanogens, fluorides, and organics, are either a) destroyed during processing, b) converted to valuable compounds and captured within the system, or c) utilized for reduction of iron oxide additives to produce value-added products. The EAF system employed includes a close-coupled thermal oxidizer and state-of-the-art air pollution control system (APCS). A thermal oxidizer and components of an APCS are necessary for the success of the inventive process.

Detailed chemical analyses of typical SPL samples has shown that several cyanide species are generally present, along with 5–15% fluoride and 15–50% carbon. The remainder of the SPL consists of refractory brick from the reduction cell, composed of inorganic oxides and generally very high in alumina ($Al_2O_3$). The complex nature of the SPL, and the process economics, have stymied the development of an industry-wide treatment process. However, it is specifically this complex nature that makes the EAF the ideal vessel for the processing and ultimate recycling of SPL.

The invention consists of certain novel features and a combination of parts hereinafter fully described, and particularly pointed out in the appended claims, it being understood that various changes in the details may be made without departing from the spirit, or sacrificing any of the advantages of the present invention.

BRIEF DESCRIPTION OF THE DRAWINGS

The present invention together with the above and other objects and advantages may best be understood from the following detailed description of the embodiment of the invention illustrated in the drawings, wherein.

DESCRIPTION OF THE PREFERRED EMBODIMENT

Figure 1:
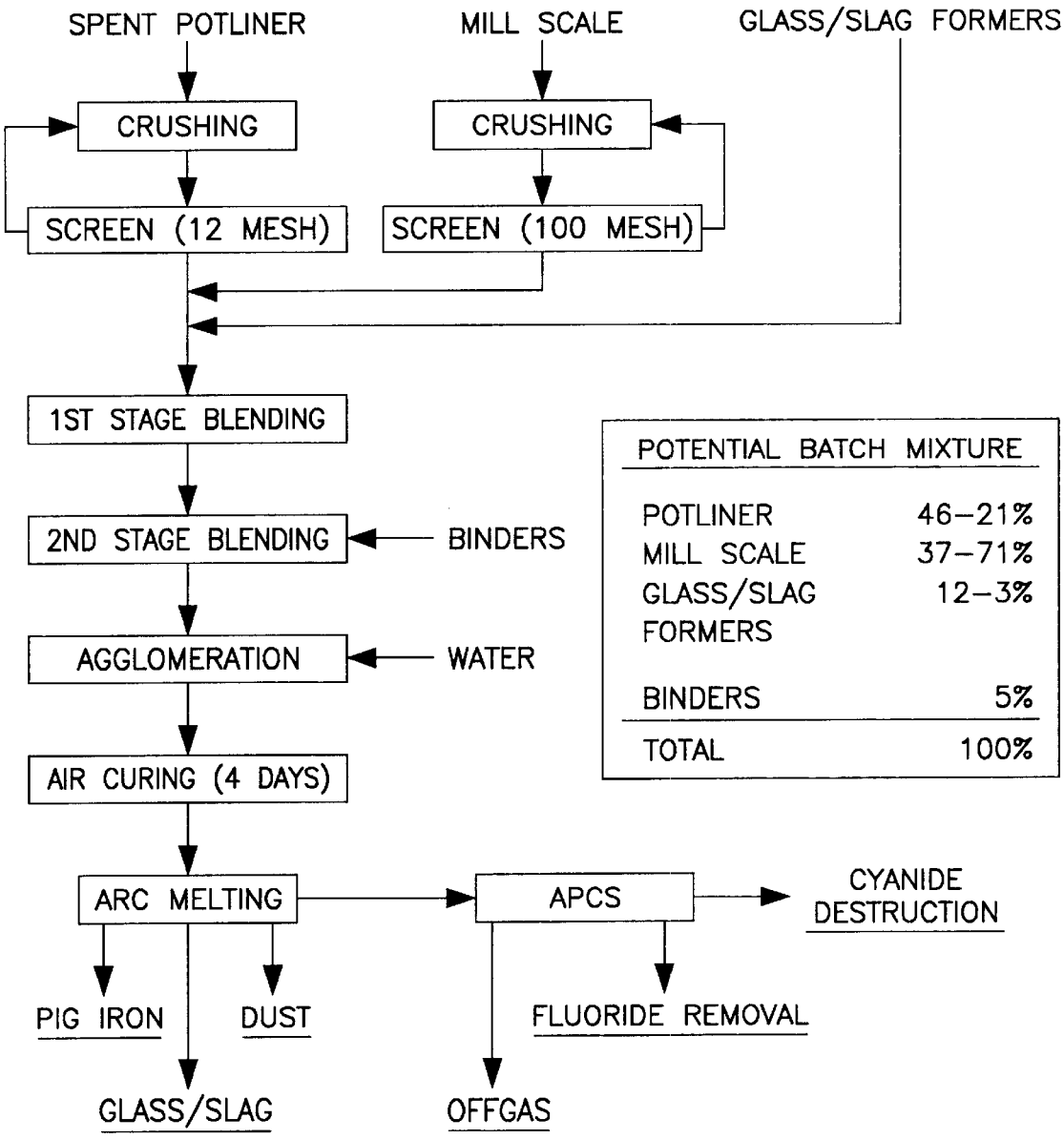
FIG. 1 is a process flow sheet of the invention.

Smelting of oxide ores in the EAF is a mature technology, in which carbon additions are made to the ore to achieve carbothermic reduction of the oxides to their metallic states. This constitutes the first part of the inventive process. The high concentrations of carbon in SPL are consumed (and utilized) by adding solid oxidants to the SPL, generally in the form of iron and steel industry wastes, such as mill scale, blast furnace sludge, or grinding swarf. Iron ore may also be used, but is more expensive. These materials are of low-value, and contain high concentrations of iron oxide, the primary solid oxidant. Primary raw materials, such as iron ore, can also be substituted for the iron oxide wastes, but economics favor the use of the iron and steel industry wastes as the source of solid oxidants. The percentage of SPL and iron oxide materials in the final combined furnace feed is based on the following reduction equations.

$$Fe_2O_3+2C \leftrightarrows Fe+FeO+2CO$$

$$FeO+C \leftrightarrows Fe+CO$$

Total stoichiometric carbon (or the theoretical carbon) necessary to reduce each of these oxide species can be summarized on a molar basis: 3 moles of carbon/mole $Fe_2O_3$, and 1 mole of carbon/mole of FeO. Carbon content of the SPL dictates the amount of iron oxide additions necessary to consume all the carbon in the SPL.

The concentrations of spent aluminum potliner and iron oxide in the combined furnace feed or agglomerated material are dependent on the carbon content of the spent aluminum potliner, which can vary from approximately 12 to 50% by weight. Based on this range of carbon content, the agglomerated material can contain spent aluminum potliner in the range of 46 to 21% by weight, and iron oxide in the range of 37 to 71% by weight. The ratio of carbon and iron varies, since there must be sufficient iron added to oxidize the carbon present in the ratio of one mole of $Fe_2O_3$ to three moles of carbon and one mole of FeO for each mole of carbon.

The combination of SPL and iron oxide materials results in the production of a value-added metallic iron product. The application of SPL, as discussed herein, utilized as a source of reductant, for the smelting of iron oxides in the EAF, is unique. This particular EAF smelting operation is conducted in submerged arc mode, meaning the electrodes of the EAF are lowered into and submerged in the molten pool. Thus, the arc is not exposed, and the molten pool is heated by radiant heat from the electrodes as well as resistance heat of the pool itself. Air ingress into the furnace is extremely limited, which creates a reducing environment within the molten pool and encourages the solid-state reduction reaction between the carbon the SPL and the iron oxide in the additives.

Process temperatures necessary for smelting the iron oxide additives are in the range of 1,350–1,650° C., which are routinely maintained in the EAF. This temperature range will be sufficient to melt all inorganic oxides contained in the SPL, which is necessary to produce a high quality slag product, suitable for use as construction fill or aggregate, or the production of a glass product suitable for use as glass wool insulation material. This constitutes the second part of the inventive process. In order to formulate a slag chemistry suitable for the targeted beneficial end-uses, additions of slag (glass) formers may also be necessary. Again, alternate waste streams may be substituted for virgin raw materials to improve economics and provide a treatment process for these other wastes. Examples of solid waste streams suitable for this purpose include coal boiler fly ash and bottom ash, electric utility neutralization sludges and spent refractories. Lime is also useful but more expensive. These materials are classified uniformly here as glass formers, and their use in place of virgin raw materials constitutes the third part of the invention process.

Figure 2:
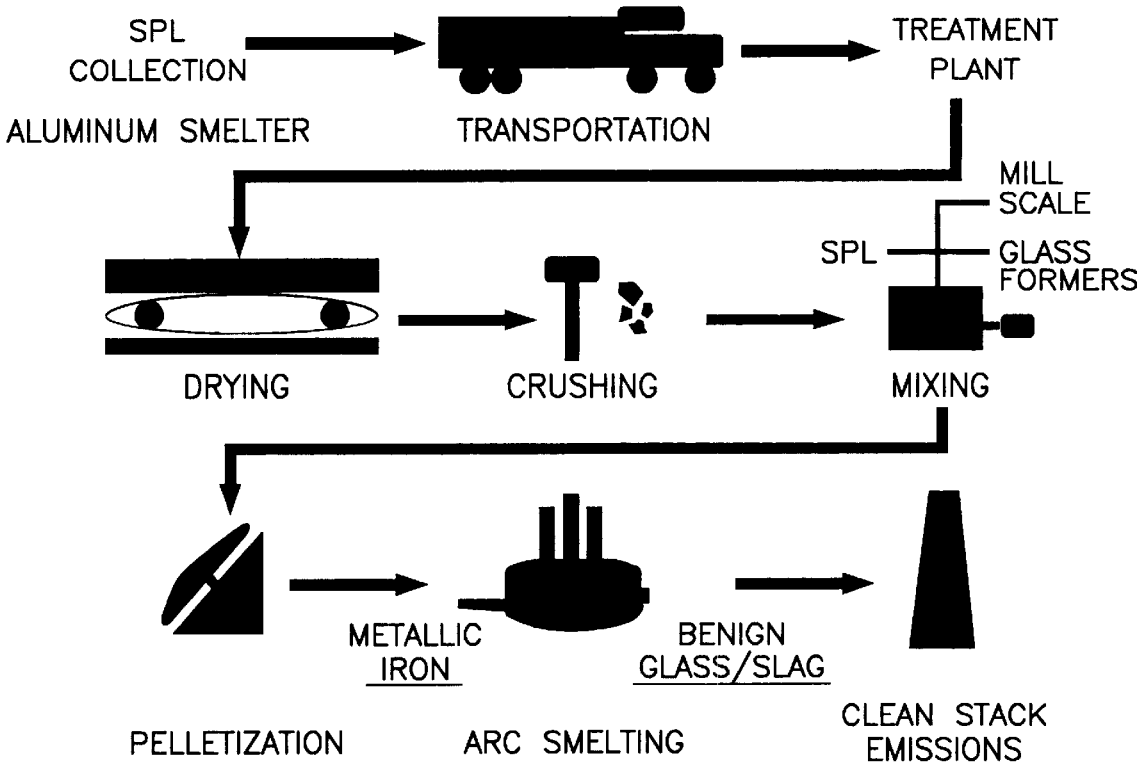
FIG. 2. is a schematic diagram of the invention.

Referring to FIGS. 1 and 2, crushing the SPL is necessary to prepare a relatively fine feed material. SPL crushed and ground through 80% minus 200 mesh (75 $\mu$m) has been used, although it is believed that grinding through 12 mesh (1,400 $\mu$m) is sufficient. Similar size reduction of the mill scale is necessary to improve reduction efficiency. In FIG. 1, a potential batch mixture includes 35% SPL, 52% mill scale (as the iron oxide source), and 7% glass formers. It is expected that the ground materials will require agglomeration, to minimize dust losses from the furnace. This will require a 5% binder addition, such as bentonite for green strength and portland cement for final cure strength, to the batch mixture.

The high temperature operation in the EAF (1,350–1,650° C.) volatilizes the organics, decomposes the cyanide compounds, and removes the fluorine from the SPL. Each of these constituents reports to the furnace offgas, which is ducted to the air pollution control system (APCS). The carbothermic reduction reaction produces carbon monoxide (CO), thus the carbon in the SPL will exit the furnace as CO gas. To ensure complete combustion of the CO to carbon dioxide ($CO_2$), destruction of the organic (ultimately to $CO_2$), and decomposition of the cyanide compounds (to $CO_2$ and nitrogen), a thermal oxidizer is close-coupled to the EAF. This constitutes the fourth part of the inventive process. The thermal oxidizer can operate at temperatures in the range of from about 600° C. to about 1350° C. in the presence of air. Fluorine in the offgas will react with moisture from the air to form hydrogen fluoride (HF) gas, which can be scrubbed from the system by contact with sodium hydroxide (NaOH) to form sodium fluoride (NaF) and water. The NaF also represents a marketable product stream, which constitutes the fifth part of the process that is the invention.

Figure 3A:
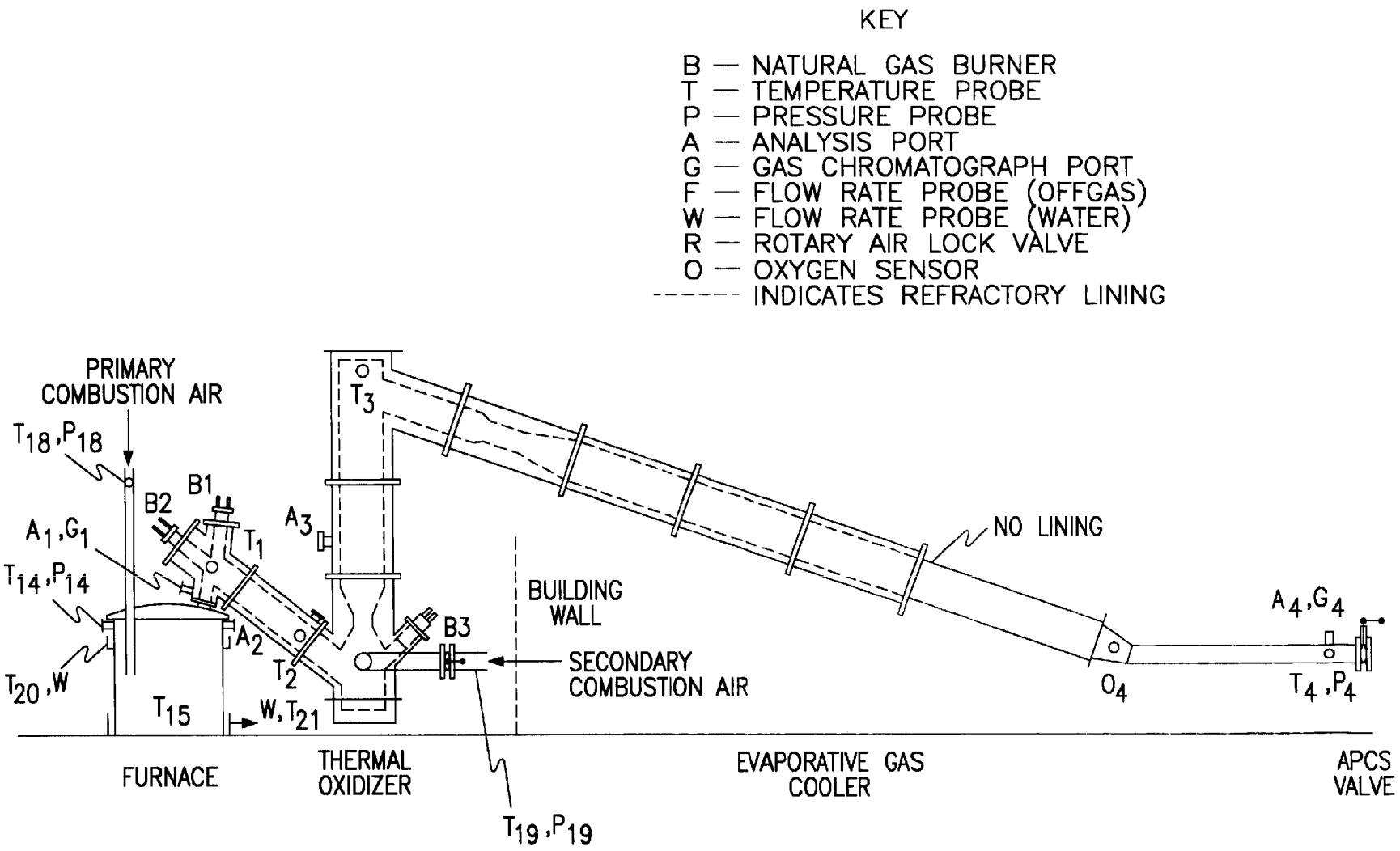
FIGS. 3*a* and 3*b* are schematic representations of acceptable air pollution control systems for use in the inventive system.
Figure 3B:
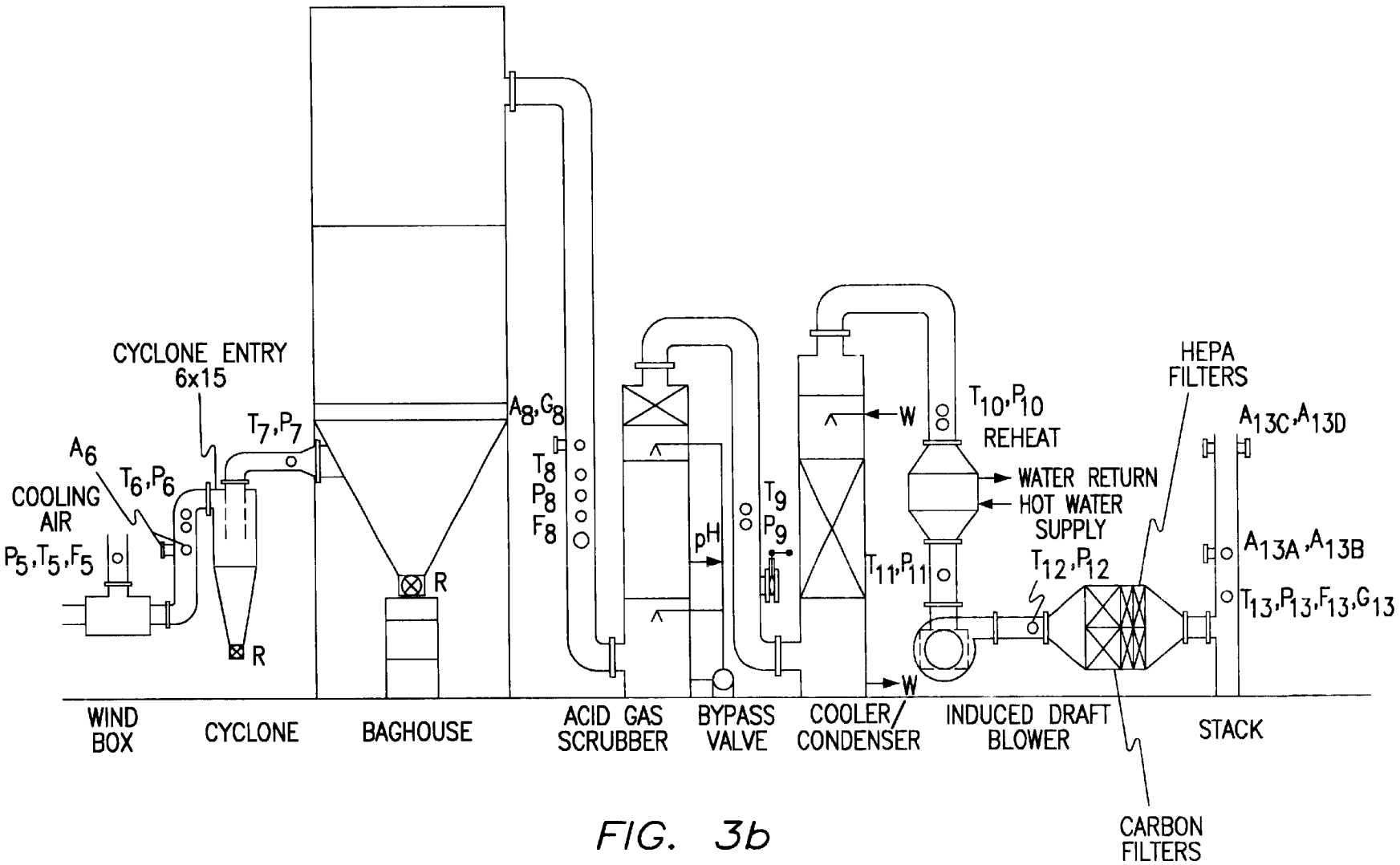

It is anticipated that the SPL collected from an aluminum smelter be transported to a suitable treatment facility, see FIG. 2, where it undergoes drying, crushing/grinding, mixing with the solid oxidants and glass formers, agglomeration (likely pelletization), and finally arc smelting. The inventive process differs from both combustion and vitrification. Combustion technologies combine the SPL with air or oxygen enriched air to oxidize the carbon in the SPL, but do not operate at sufficient temperatures to melt the inorganic oxides and produce a nonhazardous slag. Vitrification technologies are designed to produce a nonhazardous slag from the inorganic oxides in the SPL, but do not address the high carbon content and other organic contaminants. The subject invention operates at temperatures sufficient to product a nonhazardous glass or slag byproduct during the smelting of iron oxide materials. The smelting operation utilizes reduction of iron oxides rather than combustion (oxidation) to consume the carbon in the SPL and ultimately convert it to carbon dioxide. The off gas from the smelting operation is transported to an air pollution control system and after burner as shown in FIGS. 3*a* and 3*b*. While the apparatuses of FIGS. 3*a* and 3*b* are required to presently meet EPA requirements, it is within the skill in this art to design and operate such a system.

Analyses of aluminum spent potliner (SPL) were conducted on nominal 1-ton samples of SPL collected from four separate aluminum smelters. Each of the 1-ton samples was reduced in size from chunks up to 7-inches in their longest dimension to 80% minus 200 mesh (75 $\mu$m or 0.003 in) powder. Chemical analyses of each sample are included in Table 1.

TABLE 1

Elemental and species composition of several SPL samples (wt pct).

| Species | SPL1 | SPL2 | SPL3 | SPL4 |
|---|---|---|---|---|
| Al203 | 8.512 | 18.399 | 23,613 | 22.857 |
| $As_2O_3$ | <0.005 | <0.005 | <0.005 | <0.005 |
| BaO | 0.013 | 0.006 | 0.008 | 0.009 |
| CdO | <0.001 | <0.001 | <0.001 | <001 |
| CaO | 2.394 | 3.598 | 1.820 | 1.764 |
| C, fixed | 21.100 | 13,000 | 13,400 | 34,000 |
| Cl | 0.006 | 0.047 | 0.031 | 0.002 |
| $Cr_2O_3$ | 0.010 | 0.010 | 0.010 | 0.006 |
| CuO | <0.001 | 0.007 | 0.013 | <0.001 |
| CN, total | 0.133 | 0.287 | 0.062 | 0.022 |
| F | 2.680 | 7.110 | 6,710 | 5,720 |
| FeO | <0.010 | 3.137 | 4,577 | 2,160 |
| $Fe_2O_3$ | 3.230 | <0.010 | <0.010 | 0.000 |
| PbO | <0.001 | <0.001 | <0.001 | 0.005 |
| MgO | 0.305 | 0.980 | 0.343 | 0.227 |
| MnO | 0.011 | 0.019 | 0.015 | 0.011 |
| HgO | <0.00001 | <0.00001 | <0.0001 | <0.00001 |
| NiO | 0.004 | 0.006 | 0.008 | 0.010 |
| $K_2O$ | 0.331 | 0.465 | 0.422 | 0.298 |
| $P_2O_5$ | 0.066 | 0.053 | 0.088 | 0.034 |
| $SeO_2$ | <0.005 | <0.005 | <0.005 | <0.005 |
| $SiO_2$ | 31.502 | 13.072 | 30,859 | 21,8589 |
| $Ag_2O$ | <0.001 | <0.001 | <0.001 | 0.001 |
| $Na_2O$ | 14,424 | 15,367 | 15,367 | 11.391 |
| $SO_4$ | 0.384 | 0.579 | 0.268 | 0.242 |
| $TiO_2$ | 0.693 | 0.363 | 0.850 | 0.953 |
| ZnO | 0.008 | 0.010 | 0.017 | 0.002 |
| $ZrO_2$ | 0.019 | 0.009 | 0.017 | 0.012 |
| Moisture | 1.350 | 2.340 | 0.290 | 0.310 |
| Total: | 97.126 | 78.578 | 98,724 | 101.893 |

Tests were conducted on a bench-scale, 50 k W electric arc furnace. The batch mixture used for this test included the following:

| Batch Mixture: | |
|---|---|
| Spent potliner | 36% |
| Mill scale | 52% |
| Coal boiler fly ash | 12% |

Tests conducted demonstrated the successful use of SPL to reduce iron oxides from solid oxidant additives (mill scale in this case). A tap temperature of 1,388° C. was measured. Total energy consumed was 46.6 kW.h, or approximately 0.93 k W.h/lb of feed, at a feed rate of 39 lb/h. Energy consumption in an industrial-sized furnace could be expected to be from ½ to ⅓ of this figure, or about 0.30–0.50 kW.h/lb of feed (based on prior experience at ARC). The solid products from this test underwent chemical analysis, with the slag product also undergoing the Toxicity Characteristic Leaching Procedure (TCLP). The metal product contained roughly 98% iron, by weight, and could be marketed with little or no adjustment to the process. The slag product readily passed the TCLP, the results of which are reported in Table 2.

TABLE 2

TCLP results for the slag sample.

| Analyte | TCLP Limits (mg/L) | Leachate conc. (mg/L) | Element conc. in slag (mg/kg) | Percent stabilized[a] |
|---|---|---|---|---|
| Arsenic | 5.0 | <0.2 | <50 | NC |
| Barium | 100.0 | <0.5[b] | 153> | 93.46 |
| Cadmium | 1.0 | <0.1 | <20 | NC |
| Chromium | 5.0 | <0.1 | 752> | 99.73 |
| Lead | 5.01 | <0.1 | <20 | NC |
| Mercury | 0.2 | <0.1 | <0.1 | NC |
| Selenium | 0.5 | <0.2 | <50 | NC |
| Silver | 5.0 | <0.1 | <20 | NC |

[a]Percent stabilized based on 100 grams of slag placed into 2 liters of TCLP solution.
[b]Lacinate concentrations below the detection limit are assumed to be at the detection limit for percent stabilized calculation.
NC:Not calculated because both leachate and elemental concentrations are below the detection limit.

Total cyanide content of the slag was reported at 75 mg/kg. However, we believe the reported cyanide content was due to contamination from the feed, since the operating temperatures are high enough to destroy the cyanide present. The SPL sample used for this test originally contained 2,870 mg/kg total cyanide. After dilution with the other feed additives, the final furnace feed contained a minimum of 1,033 mg/kg total cyanide. Thus, even with the believed error, the total cyanide content of the slag represents 92.7% destruction of the cyanide, by processing in the electric arc furnace alone. The additional use of a close-coupled thermal oxidizer operating from about 600° C. to about 1350° C., as specified in the description of the invention, provides further reassurance of complete destruction of the cyanides.

Exhaustive calculations were made to determine the material balance, and offgas composition and flow rate resulting from treatment of the SPL by the inventive process. These calculations were based on the analyses of the SPL and a basis of a 1,000 lb/h feed rate. The process flow diagram (FIG. 1) lists the potential batch weights for a feed comprised of SPL and additives. The feed was assumed to contain an additional 5% water from the pelletization operation. Thus, at a final feed rate of 1,050 lb/h, the input mass flow rates for each component were: SPL—360 lb/h; mill scale—520 lb/h; glass formers—70 lb/h; binders—50 lb/h; and water—50 lb/h. Based on the glass/slag former content of the feed, this represents roughly 334 lb/h of slag product. Assuming 100% reduction of the iron from the mill scale, metallic iron production is approximately 328 lb/h. Offgas generation, including evolved oxygen from the mill scale, carbon and fluorine from the SPL, and hydrogen and water vapor from the moisture content of the pelletized feed is roughly 388 lb/h.

Offgas flow rates, from the feed materials only, were calculated at STP (standard temperature and pressure) for CO, HF, and $H_2O$. Based on an assumed fluorine content of the SPL (20 wt pct), about one third of the moisture content of the feed must be reduced to hydrogen to evolve all the fluorine as HF. The remainder of the feed moisture is assumed to be vaporized. The reduction of the water also consumes carbon from the potliner and/or the graphite electrodes, and produces additional CO, but that reaction was ignored for simplicity. The approximate flow rates are 82 cfm CO; 10 cfm HF; and 11 cfm $H_2O$. Reduction efficiency, calculated as the percentage of iron oxide reduced to metallic iron, is about 80%, primarily due to air infiltration into the furnace. This air infiltration leads to lower reduction efficiency due to inadvertent reaction between the carbon in the SPL and oxygen in the furnace atmosphere. The air infiltration occurs because the furnace is kept under negative pressure to assure that no gases escape into the process building. Consequently, some air is drawn into the furnace during operation. Prior experience has determined a nearly constant air infiltration rate of approximately 71 cfm. This adds about 56 cfm $N_2$ to the total furnace offgas (the oxygen is included in the CO flow rate), resulting in a total furnace offgas flow rate of roughly 159 cfm, with concentrations of 52% CO; 6% HF; 7% $H_2O$ and 35% $N_2$.

The inventive process that is the invention utilizes aluminum spent potliner (SPL) as a valuable feed component in the production of a metallic iron product, clean (nonhazardous) slag, and sodium fluoride, each suitable for recycle rather than land disposal. This process represents a potential means to eliminate a significant aluminum industry waste stream, spent potliner (K088), by the use of solid oxidants to consume the carbon in the SPL with simultaneous production of several value-added products.

While there has been disclosed what is considered to be the preferred embodiment of the present intention, it is understood that various changes in the details may be made without departing from the spirit, or sacrificing any of the advantages of the present invention.

The embodiments of the invention in which an exclusive property or privilege is claimed are defined as follows:

1. A method of processing spent aluminum pot liner containing carbon, cyanide compositions, fluorides and inorganic oxides, comprising mixing the spent aluminum pot liner with iron oxide, forming an agglomerated material from the mixture of spent aluminum pot liner and iron oxide, heating the mixture of agglomerated material in a furnace in a reducing environment to form a molten material, oxidizing carbon in the pot liner and reducing the iron oxide to produce iron and a slag substantially free of cyanide and fluorides and off-gases including carbon oxides and fluorine, and treating the off-gases containing carbon oxides and fluorine to remove fluorine therefrom.

2. The method of claim 1, wherein the oxidation and reduction steps occur at temperatures in the furnace sufficient to destroy substantially all the cyanide compositions in the spent aluminum pot liner.

3. The method of claim 2, wherein furnace temperatures are in a range of about 1,350° to about 1,650° C.

4. The method of claim 2, wherein the off-gases are passed to a thermal oxidizer to oxidize organics which may have formed and remaining cyanide compounds, and to convert substantially any CO to $CO_2$ in the off-gases.

5. The method of claim 4, wherein the off-gases from the thermal oxidizer is contacted with a liquid hydroxide to form a fluoride and remove substantially all the fluorine from the off-gases.

6. The method of claim 5, wherein the liquid hydroxide is NaOH.

7. The method of claim 1, wherein the iron oxide is selected from the group consisting of mill scale, blast furnace sludge, grinding swarf, and iron ore.

8. The process of claim 1, wherein at least some of the inorganic oxides in the spent aluminum pot liner are glass formers.

9. The method of claim 8, wherein at least some glass formers are added to the molten material and the glass formers are selected from the group consisting of coal boiler fly ash, coal boiler bottom ash, electric utility neutralization sludge, spent refractories and lime.

10. The method of claim 9, wherein the glass formers are selected from the group consisting of CaO, $SiO_2$, $Fe_2O_3$, $Al_2O_3$, and MgO.

11. The method of claim 1, wherein the furnace is operated substantially free of air.

12. The method of claim 1, wherein the spent aluminum potliner has carbon present in the range of from about 12 percent by weight to about 50 percent by weight of the potliner and the agglomerated material has potliner present in the range of from about 21 percent by weight to about 46 percent by weight and iron oxide present in the range of from about 37 percent by weight to about 71 percent by weight.

13. A method of processing spent aluminum pot liner containing carbon, cyanide compositions, fluorides and inorganic oxides, comprising crushing the spent aluminum pot liner and adding iron oxide to form an agglomerated material, forming the agglomerated material into a molten material in an electric arc furnace having electrodes submerged in the molten material to provide a reducing environment during the furnace operation, operating the electric arc furnace in a reducing environment, oxidizing the pot liner while reducing the iron oxides to produce iron and a slag substantially free of cyanide compositions and fluorides and off-gases including carbon oxides and fluorine, and treating the off-gases in an air pollution control system and afterburner and a scrubber to produce NaF, water and a gas vented to the atmosphere free of cyanide compositions, fluorine and CO.

14. The method of claim 13, wherein the electric arc furnace is operated at a temperature above about 1,350° C.

15. The method of claim 13, wherein the agglomerated material is formed from spent aluminum pot liner and iron oxide crushed to pass through a 12 mesh screen.

16. The method of claim 13, wherein the spent aluminum potliner has carbon present in the range of from about 12 percent by weight to about 50 percent by weight of the potliner and the agglomerated material has potliner present in the range of from about 21 percent by weight to about 46 percent by weight and iron oxide present in the range of from about 37 percent by weight to about 71 percent by weight.

17. The method of claim 16, wherein the agglomerated material contains about 36% by weight spent aluminum pot liner and 52% by weight iron oxide.

18. The method of claim 17, wherein agglomerated material includes about 7% by weight glass formers.

19. The method of claim 18, wherein the agglomerated material includes about 5% by weight binder.

20. The method of claim 19, wherein the binders are selected from the group consisting of bentonite, Portland cement and mixtures thereof.

* * * * *